United States Patent [19]

Larson

[11] Patent Number: 4,885,920

[45] Date of Patent: Dec. 12, 1989

[54] GARMENT SECURITY DEVICE

[76] Inventor: Donna J. Larson, 6377 Rustic Ridge La., Grand Blanc, Mich. 48439

[21] Appl. No.: 182,300

[22] Filed: Apr. 11, 1988

[51] Int. Cl.[4] ..... E05B 69/00

[52] U.S. Cl. ..... 70/49; 70/59; 211/7; 223/88; 223/92

[58] Field of Search ..... 70/59, 49, 60; 211/7, 211/4, 123; 223/88, 92, 85

[56] References Cited

U.S. PATENT DOCUMENTS

| | | | |
|---|---|---|---|
| 1,713,621 | 5/1929 | Price | 223/92 |
| 1,949,701 | 3/1934 | Vara | 223/92 X |
| 2,441,407 | 5/1948 | Glavies | 70/59 X |
| 3,568,479 | 3/1971 | Fleck et al. | 70/59 |
| 3,885,674 | 5/1975 | Rosenberg et al. | 70/59 X |
| 4,033,160 | 7/1977 | Mima | 70/49 X |
| 4,069,691 | 1/1978 | Simpson | 70/59 |
| 4,073,415 | 2/1978 | Pegg | 223/92 |
| 4,086,795 | 5/1978 | Foster et al. | 70/49 X |
| 4,265,380 | 5/1981 | Webster et al. | 223/85 |
| 4,460,092 | 7/1984 | Lee | 223/88 X |
| 4,685,572 | 8/1987 | Jamison | 70/59 X |

FOREIGN PATENT DOCUMENTS

| | | | |
|---|---|---|---|
| 447761 | 4/1948 | Canada | 223/92 |
| 2738530 | 3/1979 | Fed. Rep. of Germany | 70/59 |
| 367725 | 4/1963 | Switzerland | 70/59 |
| 2174594 | 11/1986 | United Kingdom | 223/92 |

*Primary Examiner*—Lloyd A. Gall

*Attorney, Agent, or Firm*—Arnold S. Weintraub; Gerald R. Black

[57] ABSTRACT

The garment security device can be readily secured to virtually all types of garment racks and garment hangers currently in use. When made of rugged construction the device prevents the unauthorized removal of garments from the garment rack. The device is also portable and compact so that when the device is not in use, the cable retracts and the device may be easily carried in a woman's purse. The device secures a garment to the garment rack. The garment rack includes a hanger suspended therefrom. The device includes a reelable cable located within a cable housing, wherein the cable has a lockable end. The device has locking means for locking the cable end into the security device. The locking means are preferably a lock integral to the cable housing which receives the cable end and retains it securely in place until the lock is released by the key. The device also includes mounting means which retain the device to either the garment rack or the hanger while the reelable cable end is withdrawn from the cable housing and looped through an opening within the garment and locked into the security device. After the device is locked the mounting means may or may not be released.

2 Claims, 1 Drawing Sheet

GARMENT SECURITY DEVICE

BACKGROUND OF THE INVENTION

1. Field of the Invention

This invention relates to the field of anti-theft devices for garments, and more particularly, to a novel security device that minimizes the risk of an unauthorized removal of the garment from a garment rack.

2. Background Art

There are numerous devices and systems that have been designed to prevent the unauthorized removal of garments from racks in restaurants, cloak rooms, and clothing stores. Generally, these security devices are too cumbersome and complicated for most practical applications.

Rosenberg et al in U.S. Pat. No. 3,885,674 discloses an anti-theft security device for garments wherein an enlarged retainer is secured to one end of a chain. The retainer is inserted through a sleeve of the garment, whereas the other end of the chain is secured to the garment rack.

Fernbaugh in U.S. Pat. No. 3,985,183 discloses a merchandise rack security device that is mounted above the garment rack and includes a plurality of elongated members, each of which may be inserted through one sleeve of garment, extending therethrough. The end of each elongated member has a pair of arms that when locked in the open position, prevent the removal of the garment from the rack.

Fernbaugh in U.S. Pat. No. 4,069,919 describes another garment rack security device having a plurality of elongated members. One end of each member is suspended from the garment rack, and the other end is inserted through a garment and subsequently engaged with the rack.

Jamison in U.S. Pat. No. 4,685,572 discloses a garment hanger anti-theft device which includes a chain having one end fixed to a block and the other end having a ring which passes through the sleeve of the garment and over the hook that is attached to the block.

None of these security devices have found widespread acceptance and use, since none of them can be readily adapted to the variety of different types of garment racks and hangers that are commonly used in department stores, restaurants, clubs, and hotels where garment thefts most frequently occur.

SUMMARY OF THE INVENTION

The prepared embodiment of the new garment security device can be readily secured to virtually all types of garment racks and garment hangers currently in use. When made of rugged construction the device prevents the forced removal of garments from a garment rack.

The preferred embodiment of the garment security device is portable and compact so that when the device is not in use, the cable retracts and the device may be easily stored in a woman's purse.

The garment security device secures a garment to the garment rack. The garment rack includes a hanger suspended therefrom. The device includes a reelable cable located within a cable housing, wherein the cable has a lockable end. The device has locking means for locking the cable end into the device housing. The locking means is preferably a lock integral to the cable housing which retains the cable end securely in place until the lock is released by a key. The device also includes mounting means which retain the device to either the garment rack or the hanger while the reelable cable end is withdrawn from the cable housing and looped through an opening within the garment and locked into the security device. After the device is locked, the mounting means may or may not be released.

The principles of the security device are applicable also to a security hanger. The hanger has means which enable the mounting of the garment to the garment rack (generally a hook), the mounting means being attached to an elongated hanging portion over which the garment is suspended. A reelable cable with a housing is an integral part of the hanger. The cable has an end which can be readily grasped when the cable is in the retracted position and can be engaged with a lock that is an integral part of the housing. The lock is capable of retaining the cable end. To use the device the cable end is extended through an opening in the garment and subsequently engaged with the lock, so as to prevent the unauthorized removal of the garment from the hanger. The hanging portion of the hanger may consist of telescoping sections, which collapse into each other for compact storage.

Another variation of the present invention is a garment security system, which consists of a garment, a hanger, the security device, and a stationary object. The stationary object has a horizontal member which has two closed ends so as to prevent the unauthorized removal of the hanger therefrom.

Since the security device is looped around the garment rack, the system is secure even if the hanger is not secured to the rack. Even if the hanger is subsequently lifted from the rack, the garment is secured thereto because of the looping engagement with the rack, and the rack having two closed ends thereby preventing removal of the device from the rack. The initial engagement of the device to the hanger is used as a mounting convenience to enable the withdrawal of the cable from the reel and the subsequent engagement of the device to the garment and the rack.

For a more complete understanding of the security system of the present invention, reference is made to the following detailed description and accompanying drawings in which the presently preferred embodiment of the invention is illustrated by way of example. It is expressly understood, however, that the drawings are for purposes of illustration and description only, and are not intended as a definition of the limits of the invention. Throughout the following description and drawings, identical reference numbers refer to the same component throughout the several views.

DETAILED DESCRIPTION OF THE INVENTION

Figure 1:
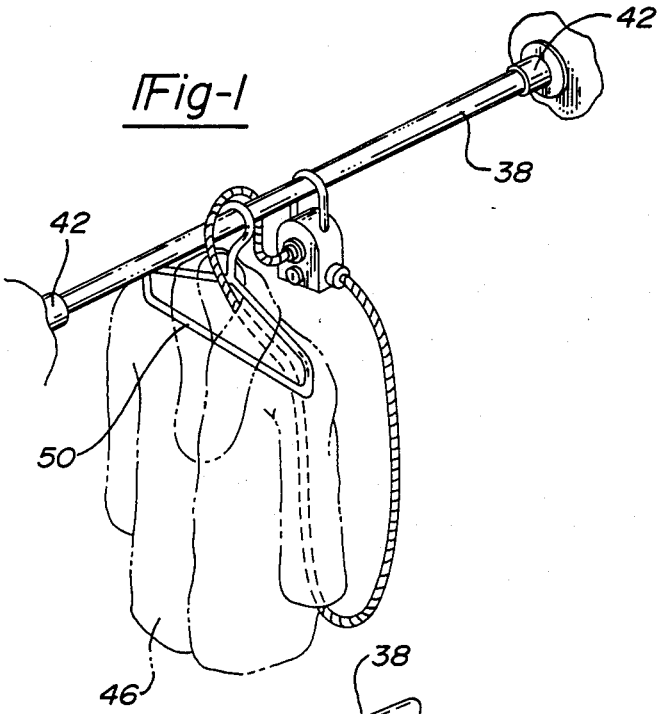
FIG. 1 is a perspective view of the preferred embodiment of the garment security device depicting the cable in the extended position looped around a garment rack and a garment suspended from a hanger.
Figure 2:
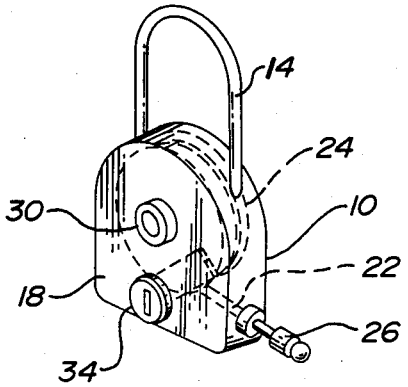
FIG. 2 is another perspective view of the embodiment shown in FIG. 1 with the reelable cable in the retracted position.

Referring now to the drawings, FIGS. 1 and 2 depict the preferred embodiment of the garment security device 10. The device 10 secures a garment 46 to a garment rack 38. Although a pole is depicted in the drawings, the device 10 can be used with any conventional rack that is used in most large department stores. The garment rack 38 includes a hanger 50 suspended therefrom. The device 10 includes a reelable cable 24 located within a cable housing 18, wherein the cable 24 has a lockable end 26. The device 10 has locking means 34 for securing the cable end 26 into the security device 10. The locking means 34 is preferably a lock integral to the cable housing 18 which retains the cable end 26 securely in place until the lock 34 is released by the key. The device 10 also includes mounting means 14 which retain the device 10 to either the garment rack 38 or the hanger 50 while the reelable cable end 26 is withdrawn from the cable housing 18 and looped through an opening within the garment and locked into the security device 10. After the device 10 is locked the mounting means 14 may or may not be released.

The reelable cable 24 is preferably spring wound so that it automatically retracts when not in use. To engage the security device, the lockable end 26 of the reelable cable 24 is looped through the garment 46 and looped over the garment rock 38. The reelable cable 24 has one end fixed to a rotatable spool and is windable upon the spool for storage thereon. The cable housing 18 is made of a lightweight plastic material. The reelable cable 24 is spring tensioned so that the cable 24 automatically retracts when the lockable end 26 is disengaged. The rotatable spool within the housing 18 may be freely rotated. The other end of the cable is lockable and may be extended from the housing 18 around a stationary object 38 and locked into the housing 18. The lockable end 26 is enlarged to mate with a recess 30 in the housing 18 when in lockable engagement therewith. The cable 24 is conventional stranded steel. Although any length of steel cable may be used, the desired length is about five feet.

The cable spool is locked in place when the lockable cable end 26 is engaged into the recess 30. The cable 24 is released when the free end 26 is removed from the recess 30. The free end 26 of the cable 24 extends through a recess 30 in the cable housing 18 and is affixed thereto. The lock 34 may be key or combination actuated although a key is preferred. The manual rotation of the key will lock and unlock the tumblers.

Figure 3:
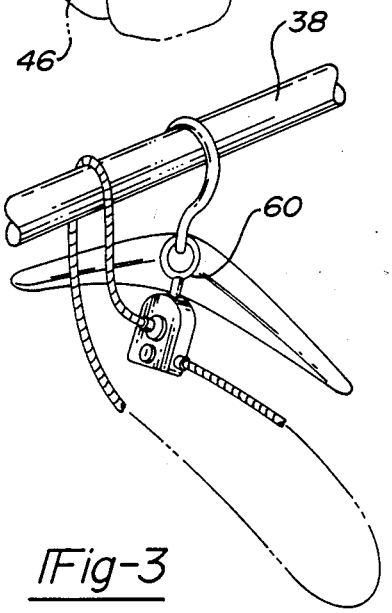
FIG. 3 depicts another embodiment of the garment security device secured to a conventional hanger, and the hanger being suspended and removable from a horizontal pole.
Figure 4:
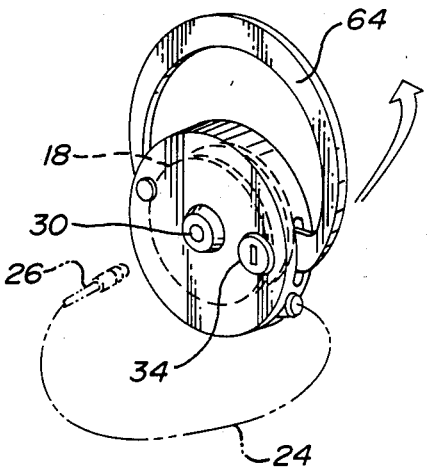
FIG. 4 depicts still another embodiment of the garment security device having a different shaped attaching member.

FIG. 3 depicts another variation of the garment security device wherein the mounting means is circular in shape and mountable around the hook portion of the hanger 50. FIG. 4 depicts yet another variation of the garment security device 10 wherein both the mounting means 64 and the lockable cable end 26 are interconnected to the locking means 34 which is integral with the housing 18.

Figure 5:
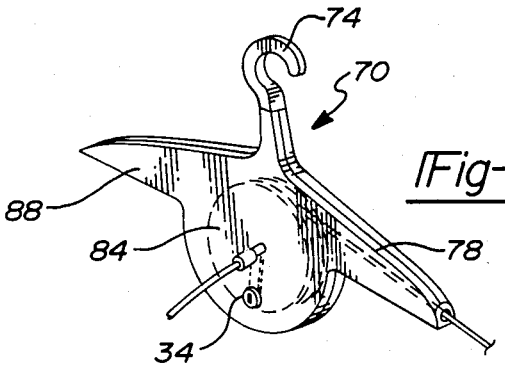
FIG. 5 depicts another embodiment of the present invention, wherein the reelable cable and the lock are an integral part of a security hanger.
Figure 5B:
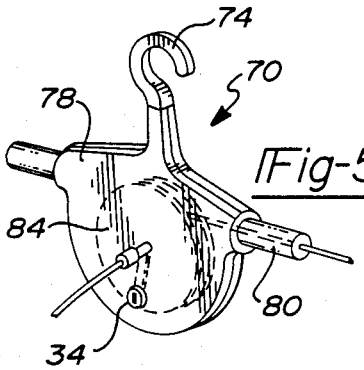
FIG. 5B depicts another embodiment of the security hanger of FIG. 5.

Referring now to FIG. 5, the security device is integral to a security hanger 70. The hanger has means 74 which enable the mounting or the garment 46 to the garment rack 38, the mounting means 74 being atached to an elongated hanging portion 78 over which the garment 46 is suspended. A reelable cable 84 with a housing 88 is an integral part of the hanger 78. The cable 84 has an end 26 which can be readily grasped when the cable 84 is in the retracted position and can be engaged with a lock 34 which is an integral part of the housing 88. The lock 34 is capable of retaining the cable end 26. To use the device the cable end 26 is extended through an opening in the garment 46 and subsequently engaged with the lock, so as to prevent the unauthorized removal of the garment 46 from the hanger 70. The hanging portion 78 of the hanger 70 may consist of telescoping sections 80, which collapse into each other for compact storage (see FIG. 5B).

The garment rack may be a conventional clothes rack on casters that is currently in use in most department stores, or the garment rack may be an elongated cylindrical bar suspended between two vertical planes (as shown in FIG. 1). Since the security device is intertwined with the garment and the garment rack, the security device works in combination with the hanger to secure the garment to the garment rack. Either the rack must have two closed ends (the engaged security device with the locked cable cannot be slid off the ends), or the engaging means of the hanger must be slidably secured to the rack so that the hanger cannot be removed therefrom. If the security device is mounted onto a garment rack with two closed ends and a detachable hanger, the garment is secured to the horizontal member since the reelable cable is anchored to the rack.

The security device as described herein is preferably used for coats and jackets because of the high cost of such garments. For coats and jackets the cable is looped through the sleeve thereof to secure the coat or jacket to the garment rack.

While the invention has been described in conjunction with a specific embodiment, it is evident that many alternatives, modifications, and variations will be apparent to those skilled inthe art in light of the disclosure herein. It is intended that all such alternatives, modifications, and variations are included herein that fall within the spirit and scope of the appended claims.

I claim:

1. A security hanger which prevents the unauthorized removal of a garment from a conventional garment rack, the security hanger being portable and compact when not in use enabling convenient storage in a handbag, the security hanger comprising:

(a) a hanger housing;

(b) a reelable cable disposed within the hanger housing, the reelable cable having a lockable end, the reelable cable being spring tensioned enabling the reelable cable to automatically retract into the hanger housing when the lockable end is disengaged, the lockable cable end being readily graspable when the reelable cable is in the retracted position;

(c) an elongated shoulder portion over which the garment may be suspended, the elongated shoulder portion comprising telescoping sections which collapse into each other for compact storage, the reelable cable extending through a telescoping section of the shoulder portion;

(d) means for locking the cable end into the hanger housing, the locking means being integral to the hanger housing, the lockable cable end being cooperatively engageable within the locking means until the locking means is released; and (e) hooking means for mounting the housing to the garment rack, the hooking means being engageable to and disengageable from the garment rack.

2. The security hanger of claim 1, wherein the locking means is key actuated, and the manual rotation of the key disengages the tumblers.

* * * * *